United States Patent [19]

Kurtin et al.

[11] 4,275,267

[45] Jun. 23, 1981

[54] AMBIENCE PROCESSOR

[75] Inventors: Stephen L. Kurtin, Sherman Oaks; Edward C. Kelm, Pasadena, both of Calif.

[73] Assignee: Koss Corporation, Milwaukee, Wis.

[21] Appl. No.: 43,716

[22] Filed: May 30, 1979

[51] Int. Cl.[3] ..... H04R 3/00

[52] U.S. Cl. ..... 179/1 J; 179/1 G; 84/DIG. 26

[58] Field of Search ..... 179/1 J, 1 G, 1 GP, 179/100.1 TD, 100.4 ST; 84/1.24, DIG. 26

[56] References Cited

U.S. PATENT DOCUMENTS

| | | | |
|---|---|---|---|
| 3,117,289 | 1/1964 | Grandstaff et al. | 331/113 A |
| 3,145,265 | 8/1964 | Tamura et al. | 179/1 J |
| 3,177,289 | 4/1965 | Kerckoff | 179/1 G |
| 3,711,850 | 1/1973 | Kelly | 340/347 NT |
| 3,737,897 | 6/1973 | Cuthbert et al. | 340/347 AD |
| 3,877,026 | 4/1975 | Wintz et al. | 340/347 AD |
| 3,905,028 | 9/1975 | Wintz et al. | 340/347 AD |
| 3,934,094 | 1/1976 | Kobayashi et al. | 179/15.55 T |
| 3,949,299 | 4/1976 | Song | 375/31 |
| 3,979,676 | 9/1976 | Poma | 375/32 |
| 3,981,005 | 9/1976 | Takayama et al. | 340/347 AD |
| 4,027,101 | 5/1977 | DeFreitas et al. | 179/1 GQ |
| 4,039,755 | 8/1977 | Berkovitz | 179/1 G |
| 4,049,912 | 9/1977 | Mitchell | 179/1 GQ |
| 4,053,711 | 10/1977 | DeFreitas et al. | 179/1 GQ |
| 4,063,034 | 12/1977 | Peters | 179/1 J |
| 4,087,629 | 5/1978 | Atoji et al. | 179/1 G |
| 4,101,881 | 7/1978 | DeFreitas | 340/347 R |
| 4,105,864 | 8/1978 | Berkovitz | 179/1 J |
| 4,121,058 | 10/1978 | Jusko et al. | 179/15.55 T |

OTHER PUBLICATIONS

"High Performance Delta Modulation is Both Simple and Economical" presented at the 63rd Convention of the Audio Engineering Society by Richard E. DeFreitas and Peter W. Mitchell in May 1979.

*Primary Examiner*—Alfred H. Eddleman
*Assistant Examiner*—Joseph A. Popek
*Attorney, Agent, or Firm*—Quarles & Brady

[57] ABSTRACT

An ambience processor receives and combines the left and right channel signals from a stereophonic amplifier. The resulting composite signal is converted to a sequence of digital signals which are stored in a random access memory. The stored digital representation of the composite signal is read out of the random access memory at different times to separate output circuits which drive left channel and right channel ambience loudspeakers. Reverberation effects are obtained by feeding back portions of the separate output signals to the input of the system.

11 Claims, 5 Drawing Figures

8
7
137L
138L
137R
138R
+25V
-25V
+25V
-25V
137L
137R
28
26
136L
136R
135L
135R
134
132L
132R
133L
133R
29
27
25
30
131L
128L
131R
128R
130L
130R
129L
129R
23
127L
127R
22
+12V
+12V
126L
126R
125L
125R
Q
D
C
Q
D
C
21
16
115

AMBIENCE PROCESSOR

BACKGROUND OF THE INVENTION

The field of the invention is high fidelity sound reproduction systems and more particularly, circuits for enhancing the quality of stereophonic sound by generating reverberant sounds similar to those which occur due to ambient conditions in large rooms, auditoriums or theaters.

Ambience processors are well known to the art. They typically use various delay, feedback and mixing techniques to generate audio signals, which when applied to the ambience loudspeakers, will generate sounds that are similar to those that reach a listener's ears by indirect paths such as reflections from the walls and ceiling of a theater, auditorium, or other room. Where stereophonic program material is reproduced, prior ambience processors which utilize delay devices have uniformly employed separate delay devices and associated circuitry for each channel to generate separate left and right channel ambience signals for the respective left and right ambience loudspeakers. Such ambience loudspeakers are typically placed on either side of the listener, or behind the listener as he faces the two loudspeakers that reproduce the main left and right channel audio signals.

SUMMARY OF THE INVENTION

The present invention relates to an ambience processor which receives left channel and right channel stereophonic audio signals and generates distinct left channel and right channel ambience audio signals using a single channel of delay. More specifically, the invention includes an input circuit which receives and combines the left channel and right channel signals into a composite audio signal which is applied to the input of a delay device that imparts a first selected delay to the applied signal and a second selected delay to the applied signal, a left channel output circuit coupled to receive one of said delayed signals and generate a left channel ambience audio signal and a right channel output circuit coupled to receive the other of said delayed signals and generate a right channel ambience audio signal.

The invention also provides a reverberation circuit which feeds back to the input of the delay device a portion of both of the delayed signals.

The invention also relates to a delay device which employs a random access memory and a memory address circuit. As the memory address circuit generates a sequence of base addresses a digitized representation of the composite audio signal is written into the addressed random access memory locations. In addition, the memory address circuit generates a sequence of first modified addresses which are applied to the random access memory to read out a digitized representation of one of the delayed signals and it generates a sequence of second modified addresses which are applied to the random access memory to read out a digitized representation of the other delayed signal. As each write operation is performed using a base address during the scan through the random access memory locations, two read operations are performed to output previously stored data from the memory. Each such first read operation uses an address which is modified a first preselected amount from the base address and each such second read operation uses another address which is modified a second preselected amount from the base address. Two separate sequences of digitized data are thus produced by the read operations.

Yet another aspect of the invention is the manner in which the ambience processor is coupled to commercially available stereophonic amplifiers. More particularly, the ambience processor input circuit is coupled to the right channel audio output terminal through a first voltage divider network and isolation transformer, and it is coupled to the left channel audio output terminal through a second voltage divider network and isolation transformer. The voltage divider network provides a negligible load for commercially available power amplifiers and the electrical transformer isolates the ambience processor circuitry from that of the power amplifier.

A general object of the invention is to minimize the circuitry, and hence cost, in a stereophonic ambience processor. By combining the stereophonic signals to form a composite audio signal, only a single analog-to-digital converter circuit and a single delay channel are required. The complexity and cost of the system is further reduced by employing a delta modulator as the analog-to-digital converter circuit and by employing commercially available integrated circuits for the random access memory, the memory address circuit and the associated timing circuitry.

A specific object of the invention is to provide a means for detecting an overload condition in the delta modulator circuit. A diode bridge circuit is connected to the input of the delta modulator and an illuminating device is energized by this diode bridge circuit when the rate of change of the applied composite audio signal is excessive.

Another object of the invention is to provide a means for manually selecting the delays imposed by the delay circuit. A selector switch connects to the memory address circuit and it enables the user to change the generated modified address sequences.

The foregoing and other objects and advantages of the invention will appear from the following description. In the description, reference is made to the accompanying drawings which form a part thereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
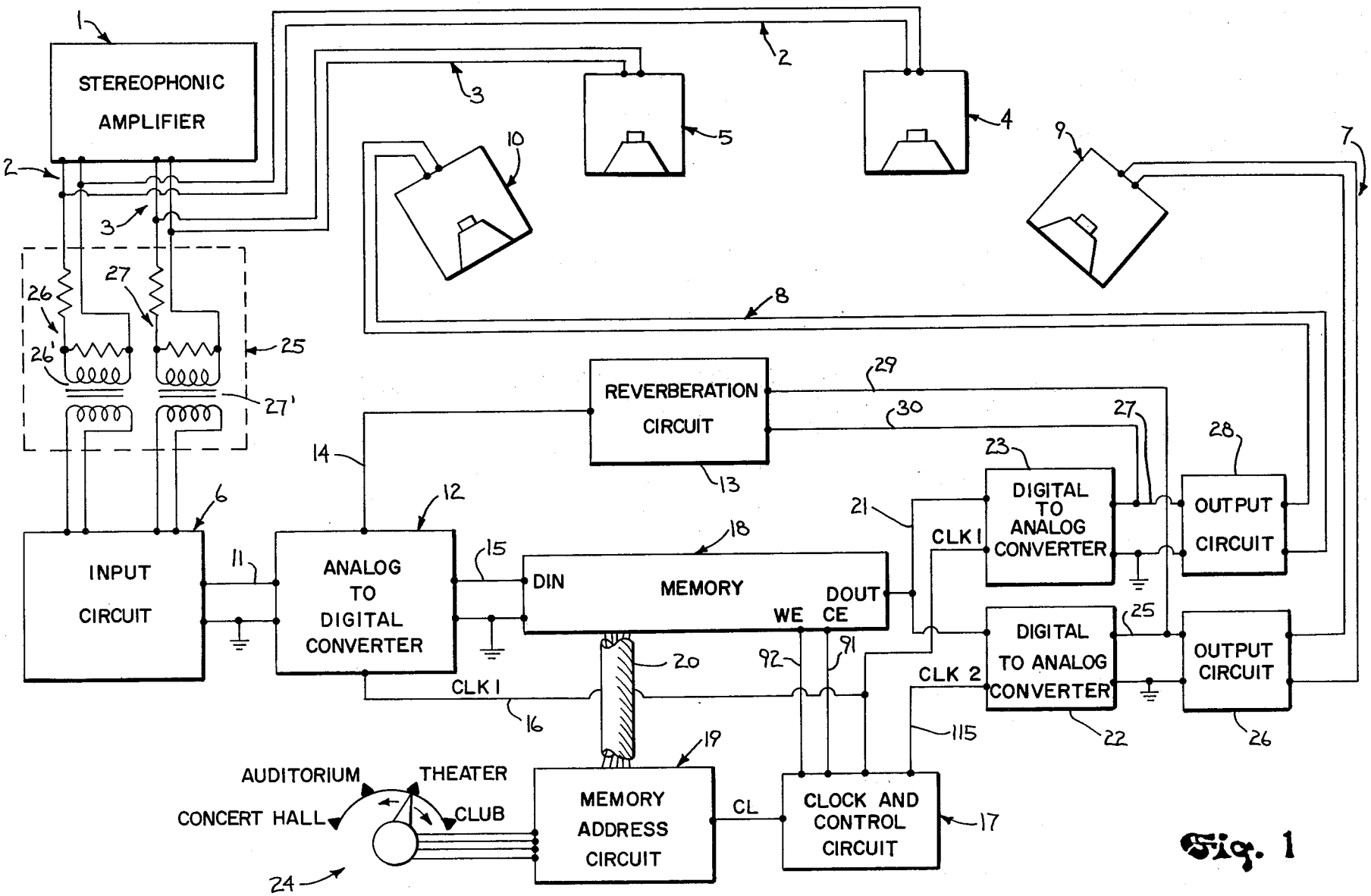
FIG. 1 is an electrical block diagram of the ambience processor of the present invention connected to a stereophonic amplifier and four loadspeakers.

Referring to FIG. 1, a stereophonic amplifier 1 generates a right channel audio signal at a pair of output lines 2 and a left channel audio signal at a pair of output lines 3. The output lines 2 and 3 are connected directly to conventional loudspeaker systems 4 and 5 which convert the right and left channel audio signals into stereophonic sound.

The present invention resides in an ambience processor which connects to receive the right channel and left channel audio signals at an input circuit 6 and which converts these signals into right and left channel ambience signals that are applied through respective output lines 7 and 8 to a right ambience loudspeaker 9 and a left ambience loudspeaker 10. The sound reproduced by the ambience loudspeakers 9 and 10 is similar to the sounds which are reflected from the walls and furnishings of a room much larger than the average living room. Such ambient sounds are comprised of a complex mixture of left channel and right channel stereophonic information which is delayed in time and multiply recycled before reaching the listener. It is the primary function of the ambience processor to mix left channel and right channel audio signals and to impose time delays which are similar to those that occur when listening to a live performance.

The ambience processor is coupled to the amplifier outputs 2 and 3 through an isolation circuit 25 which includes resistive voltage divider networks 26 and 27 and isolation transformers 26' and 27'. The audio signals are applied to the primaries of the isolation transformers through the voltage dividers 26 and 27 which present a low impedance source for driving the transformers 26' and 27' at low distortion and with a wide band width. The voltage dividers 26 and 27 also present a high impedance to the stereo amplifier thereby assuring an absence of appreciable loading. The secondary windings are connected to the input circuit 6 and the primary windings are thus floating to virtually eliminate any possibility of interconnection problems such as ground loops or partial shorting of bridge-type power amplifiers.

The ambience processor includes a number of circuits which are indicated generally as blocks in FIG. 1. The left channel and right channel audio signals are received at the input circuit 6 where they are combined into a single, composite audio signal. This composite audio signal is coupled through a line 11 to the input of an analog-to-digital converter circuit 12. The analog-to-digital converter circuit 12 combines the composite analog signal with an analog feedback signal received from a reverberation circuit 13 through a line 14 and converts the resulting analog audio signal into a sequence of logic low and logic high voltage levels which are generated on a line 15. The operation of the analog-to-digital converter circuit 12 is synchronized with other elements in the system through a CLK1 control line 16 which is driven by a clock and control circuit 17.

The digitized composite signal generated by the analog-to-digital converter 12 is applied to the data input terminal of a memory 18. The memory 18 is a random access memory containing a plurality of memory locations which are separately addressed by a memory address circuit 19 through an address bus 20. The sequence of digital signals generated by the analog-to-digital converter circuit 12 are written into successive memory locations in the memory 18 and digitized signals which were previously stored in the memory 18 are addressed and sequentially read out of the memory 18 through a data output line 21. The memory 18 is large enough to store 70.1 milliseconds of digitized composite audio signals.

The data output line 21 on the memory 18 connects to the input of a right channel digital-to-analog converter circuit 22 and to the input of a left channel digital-to-analog converter circuit 23. As will be described in more detail hereinafter, the clock and control circuit 17 operates in combination with the memory address circuit 19 to sequentially read digitized data out of the memory 18 to the right channel digital-to-analog converter 22 which is delayed a first predetermined amount with respect to the digitized composite signal data being written into the memory 18. Similarly, these circuits operate to read out of the memory 18 a sequence of data to the left channel digital-to-analog converter circuit 23 which is delayed for a second predetermined time interval. The amount of time delay imposed by the ambience processor is manually selected by a four-pole, four-position selector switch 24. The time delays provided by the ambience processor are listed in Table A and it should be noted that the ratio of the left channel delay to the right channel delay is approximately 0.6 to 1.

TABLE A

| SELECTOR SWITCH SETTING | LONG DELAY (pHϕ) NO. ADDED | LONG DELAY (pHϕ) DELAY | SHORT DELAY (PH1) NO. ADDED | SHORT DELAY (PH1) DELAY |
|---|---|---|---|---|
| Concert Hall | 0000 | 70.1 msec. | 0110 | 43.8 msec. |
| Auditorium | 0011 | 56.9 msec. | 1000 | 35.0 msec. |
| Theater | 1000 | 35.0 msec. | 1011 | 21.9 msec. |
| Club | 1011 | 21.9 msec. | 1101 | 13.1 msec. |

The digital-to-analog converter circuits 22 and 23 are identical, and each operates to transform the sequence of digital data received from the memory 18 into an analog audio signal. The right channel audio signal is generated through a line 25 to an output circuit 26 and the left channel audio signal is generated on a line 27 to an output circuit 28. The output circuits 26 and 28 are identical and they each provide voltage and power amplification sufficient to drive the respective ambience loudspeakers 9 and 10.

To effectively produce ambience signals a portion of the audio signals generated by the digital-to-analog converter circuits 22 and 23 are fed back through lines 29 and 30 to the reverberation circuit 13. The reverberation circuit 13 combines the two audio feedback signals and applies the result through the line 14 to the analog-to-digital converter 12. There it is combined with the composite audio signal which is also applied to the analog-to-digital converter circuit 12.

The ambience processor thus combines the left channel and right channel audio signals, delays the resulting composite signal a first predetermined amount for application to one ambience loudspeaker and delays the composite signal a second predetermined amount for application to the other ambience loudspeaker. A portion of each delayed signal is fed back through the system to generate further mixed and delayed components and thereby to provide the desired ambience sound. A detailed description of the ambience processor circuitry will now be made with reference to FIG. 1 and the other drawings.

Figure 2:
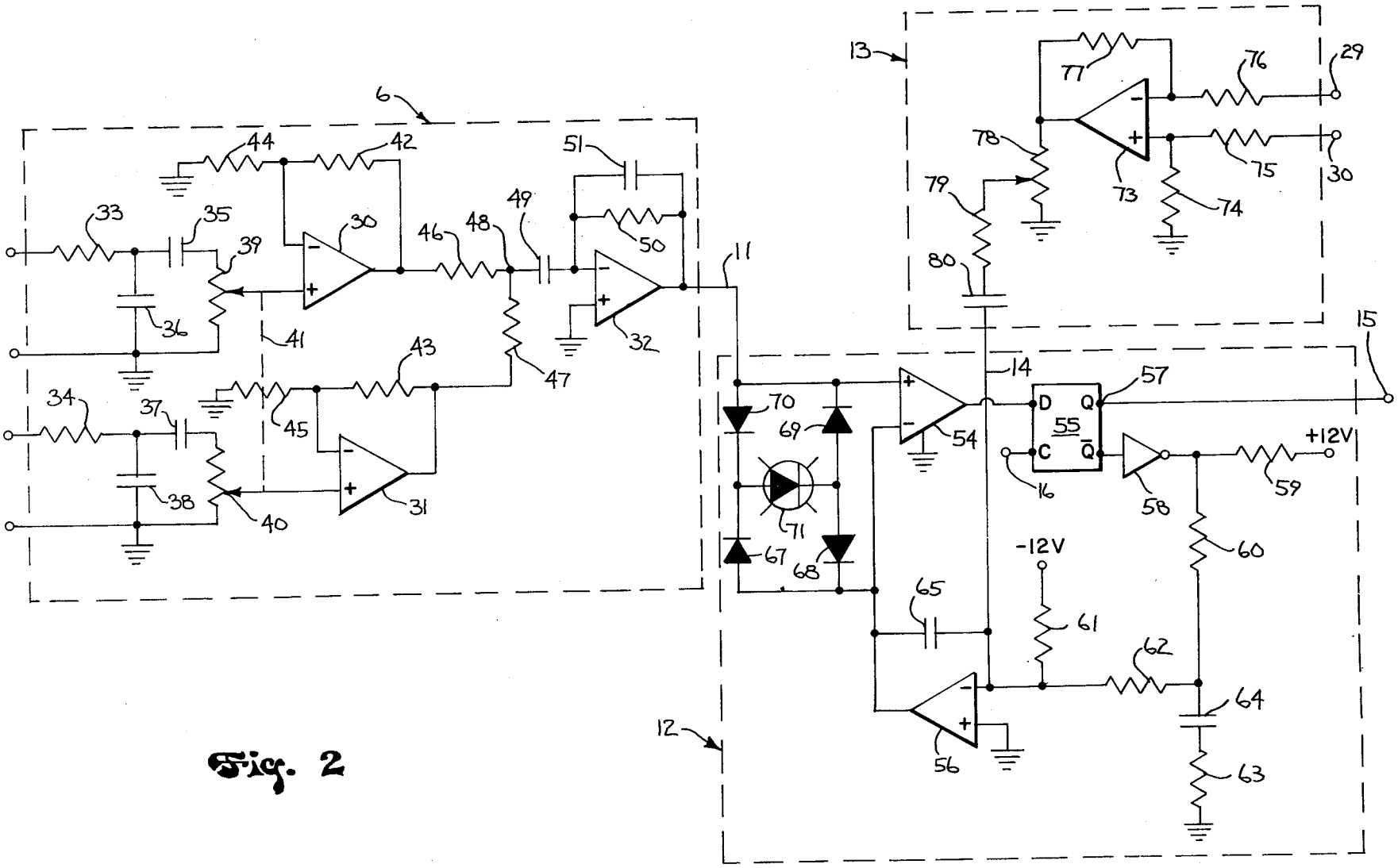
FIG. 2 is an electrical schematic diagram of an input circuit, an analog-to-digital converter circuit and a reverberation circuit which form part of the ambience processor of FIG. 1.

Referring particularly to FIGS. 1 and 2, the input circuit 6 includes two identical first stage amplifier circuits constructed around respective operational amplifiers 30 and 31 and a buffer amplifier circuit which is constructed around an operational amplifier 32. The noninverting input of operational amplifier 30 receives the left channel audio signal and the noninverting input terminal on the operational amplifier 31 receives the right channel audio signal. Filter networks comprised of resistors 33 and 34 and capacitors 35–38 block radio frequency signals and provide d.c. isolation. Logarithmic gain potentiometers 39 and 40 receive the input signals and enable the input circuit 6 to accommodate audio signals of various amplitudes. The sliders on the potentiometers 39 and 40 are mechanically coupled together as indicated by dashed line 41 and these may be manually set to adjust the gain of the input circuit 6. The gain of the first amplifier stages are set to twenty-one by respective feedback resistors 42 and 43 and input resistors 44 and 45. The outputs of the operational amplifiers 30 and 31 are coupled through resistors 46 and 47 to a summing point 48 where the left channel and right channel audio signals are combined to form the composite audio signal.

The composite audio signal which appears at the summing point 48 is applied through a coupling capacitor 49 to the inverting input of the operational amplifier 32. The noninverting input of the amplifier 32 is connected to signal ground and its output connects to the line 11 which drives the analog-to-digital converter circuit 12. A feedback resistor 50 associated with the operational amplifier 32 is selected to provide a gain of four and one half and the value of a feedback capacitor 51 is selected to provide a 7.2 kHz low pass roll off. The input circuit 6 thus generates a composite audio signal which has been stripped of higher components and the circuit provides a low impedance to the analog-to-digital converter circuit 12 which it drives through the line 11.

The analog-to-digital converter circuit 12 employs a delta modulation technique for converting the applied composite audio signal to a clocked sequence of logic high and logic low voltage levels which are generated on the output line 15. Referring particularly to FIGS. 1 and 2, the composite audio signal on the line 11 is applied to one input of a comparator circuit 54. The output of the comparator circuit connects to the D input of a D-type flip-flop 55 and the other input on the comparator 54 connects to the output of an integrator circuit formed around an operational amplifier 56. The flip-flop 55 is clocked every 4.278 microseconds through the CLK1 line 16 and the output of the comparator circuit 54 (i.e., a logic high voltage or a logic low voltage) is thus stored in the flip-flop 55 and generated at its Q output terminal 57. The signal at the Q output 57 is applied to the output line 11 and the signal at the $\overline{Q}$ output of the flip-flop 55 is converted to a symmetrical bi-polar signal by an inverter gate 58 and a set of resistors 59–61. The resulting positive or negative correction signal is fed back to the inverting input of the operational amplifier 56 through a filter comprised of resistors 62 and 63 and capacitor 64. The noninverting input of the operational amplifier 56 is connected to signal ground and a capacitor 65 connects between its inverting input and its output to form an integrator circuit.

The signal applied to the comparator circuit 54 by the operational amplifier 56 is a signal derived primarily from the digital signal generated at the $\overline{Q}$ output of the flip-flop 55. This digital signal is converted into a symmetrical bipolar signal before application to the operational amplifier 56 and it is summed with a feedback signal received through the line 14 from the reverberation circuit 13. The resistors 62 and 63 and the capacitor 64 form a pole-zero pair which alters the character of the "idle noise" that may otherwise be generated by the analog-to-digital converter circuit 12 such that it is not objectionable to the listener.

The analog composite audio signal applied to the analog-to-digital converter circuit 12 is compared at the comparator circuit 54 with the reference signal lever generated by the operational amplifier 56. The digital voltage level generated by the comparator circuit 54 reflects the relative magnitudes of the composite analog audio signal and the reference signal, and this digital signal (i.e., a logic "0" or a logic "1") is clocked into the flip-flop 55 every 4.278 microseconds. A sequence of logic level signals is thus generated at the Q output 57 on the flip-flop 55 and this digitized representation of the audio signal is applied to the input of the delay memory 18 through the line 15. For a more detailed description of the thoery and operation of this type of analog-to-digital converter circuit reference is made to "Digitization of Audio: A Comprehensive Examination of the Theory, Implementation and Current Practice" by B. A. Blesser which appears in the October, 1978 issue of the *Journal of the Audio Engineering Society*, Volume 26, page 739.

The analog-to-digital converter circuit 12 encodes the rate of change of the composite audio input signal, and as a result, the circuit may be overloaded when the rate of change, or slew rate, of the applied audio signal is too high. To detect the occurrance of such an overload, the analog-to-digital converter circuit 12 includes a diode bridge comprised of four diodes 67–70 and a light emitting diode 71 connected across the inputs of the comparator circuit 54. When the difference in voltage levels between the applied composite audio signal and the reference signal exceeds the forward voltage drop across two of the diodes 67–70 and the light emitting diode 71, current flows through the light emitting diode 71 and a visual indication of the overload condition is provided. This condition can easily be corrected by reducing the gain of the input circuit 6 through the potentiometers 39 and 40.

Referring particularly to FIGS. 1 and 2, the reverberation circuit 13 operates to sum the two audio signals fed back through the lines 29 and 30 and differentiate the resulting analog audio feedback signal before applying it to the integrator circuit in the analog-to-digital converter circuit 12. The reverberation circuit 13 includes an operational amplifier 73 which has its noninverting input connected to signal ground through a resistor 74 and connected to the line 30 through a coupling resistor 75. The inverting input on the operational amplifier 73 connects to the line 29 through a second coupling resistor 76 and it connects to the output of the operational amplifier 73 through a feedback resistor 77. A potentiometer 78 connects the output of the operational amplifier 73 to signal ground and its wiper is connected through a resistor 79 and capacitor 80 to the analog-to-digital converter circuit 12.

The two analog feedback signals received by the reverberation circuit 13 through the lines 29 and 30 are summed by the operational amplifier 73. The potentiometer 78 provides a means for manually adjusting the amount of reverberation and the capacitor 80 differentiates the resulting reverberation feedback signal before its application to the integrator circuit. The resistor 79 limits the high frequency gain of the differentiator to prevent the recirculation of high frequency noise to the analog-to-digital converter circuit 12.

Figure 3:
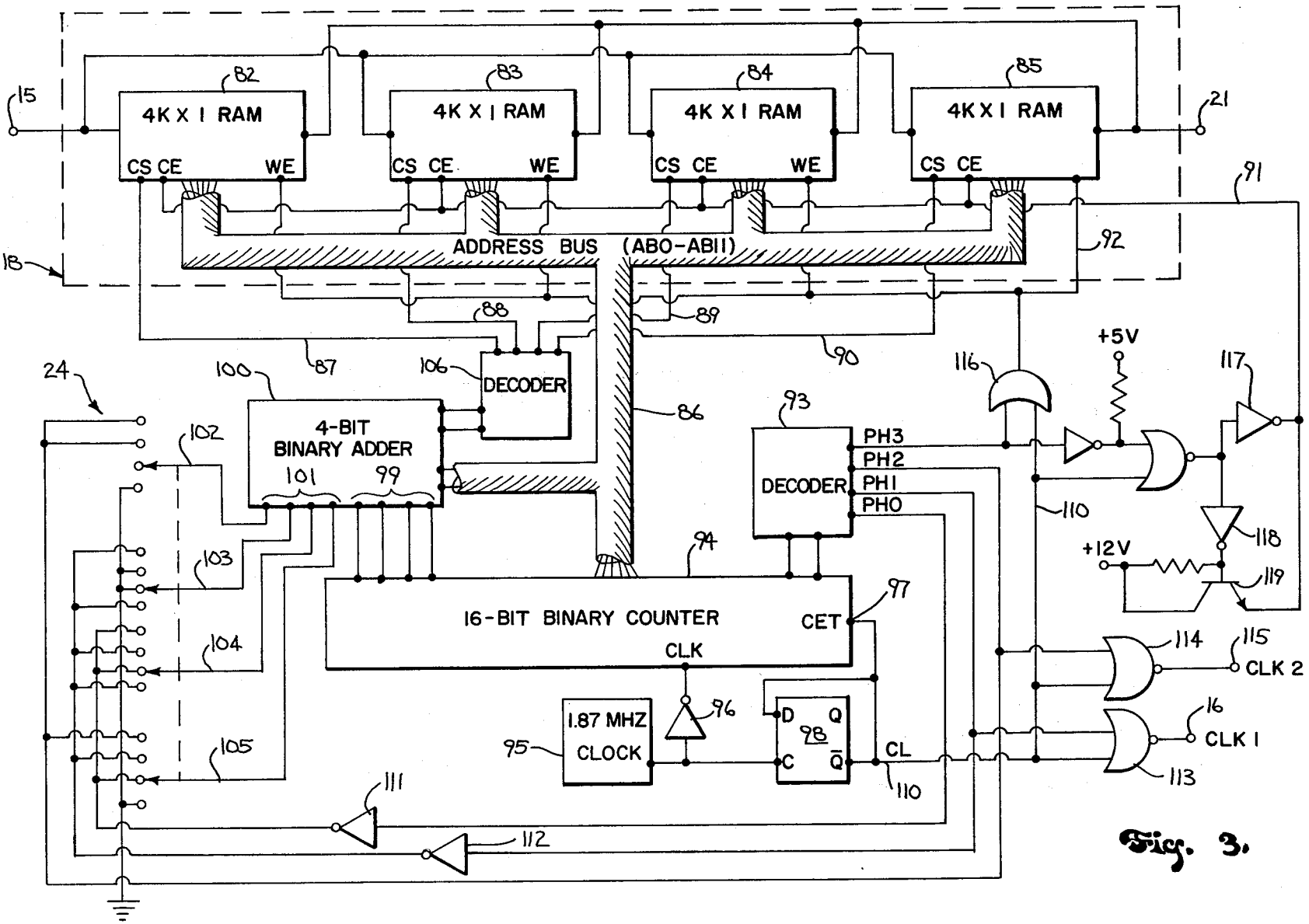
FIG. 3 is an electrical schematic diagram of a memory, a memory address circuit and a clock and control circuit which form part of the ambience processor of FIG. 1.

Referring particularly to FIGS. 1 and 3, the memory 18 is comprised of four 4,096 by 1 dynamic MOS RAM integrated circuits 82–85 which have their data input terminals connected to the line 15 and their data output terminals connected to line 21. A total of 16,384 one-bit memory locations are thus provided by the memory 18 and each of these memory locations is separately addressable through a twelve-lead address bus 86 and a set of four chip select control lines 87–90. Data is written into an addressed memory location when the memory 18 is enabled through a chip enable (CE) control line 91 and a write enable control line 92 is driven to a logic low voltage. Data is read from a selected memory location when the memory 18 is enabled by the chip enable (CE) control line 91 and the write enable control line 92 remains at a logic high voltage. For details of the read and write cycle timing, reference is made to the "Memory Data Book," pages 1–60 through 1–63 published by National Semiconductor Corporation in 1977.

The sequence of digital data received from the analog-to-digital converter circuit 12 is written into successive memory locations in the delay memory 18. The sequential selection of the proper memory locations into which this data is written is determined in part by a 16-bit binary counter 94 which is comprised of four four-bit binary counters which are cascade connected and have their clock terminals commonly connected to the clock 95 through an inverter gate 96. A count enable terminal 97 on the least significant digit counter is driven by a D-type flip-flop 98 which has its clock input terminal connected directly to the clock circuit 95. The two least significant digit data output terminals on the sixteen-bit binary counter 94 connect to the inputs of a two-line-to-four-line decoder circuit 98 and the next ten least significant digit data output terminals connect to respective leads in the address bus 86. The four most significant digit data output terminals on the binary counter 94 connect to the four "B" input terminals 99 on a four-bit binary adder circuit 100 and the four "A" inputs 101 on the binary adder circuit 100 connect to the respective four poles 102–105 on the selector switch 24.

The two least significant digit output terminals on the binary adder circuit 100 connect to the two most significant digit leads in the address bus 86 and the two most significant digit output terminals on the adder circuit connect to the inputs of a second two-line-to-four-line decoder circuit 106. The four output terminals on the decoder circuit 106 drive the respective chip select (CS) control lines 87–90.

Figure 5:
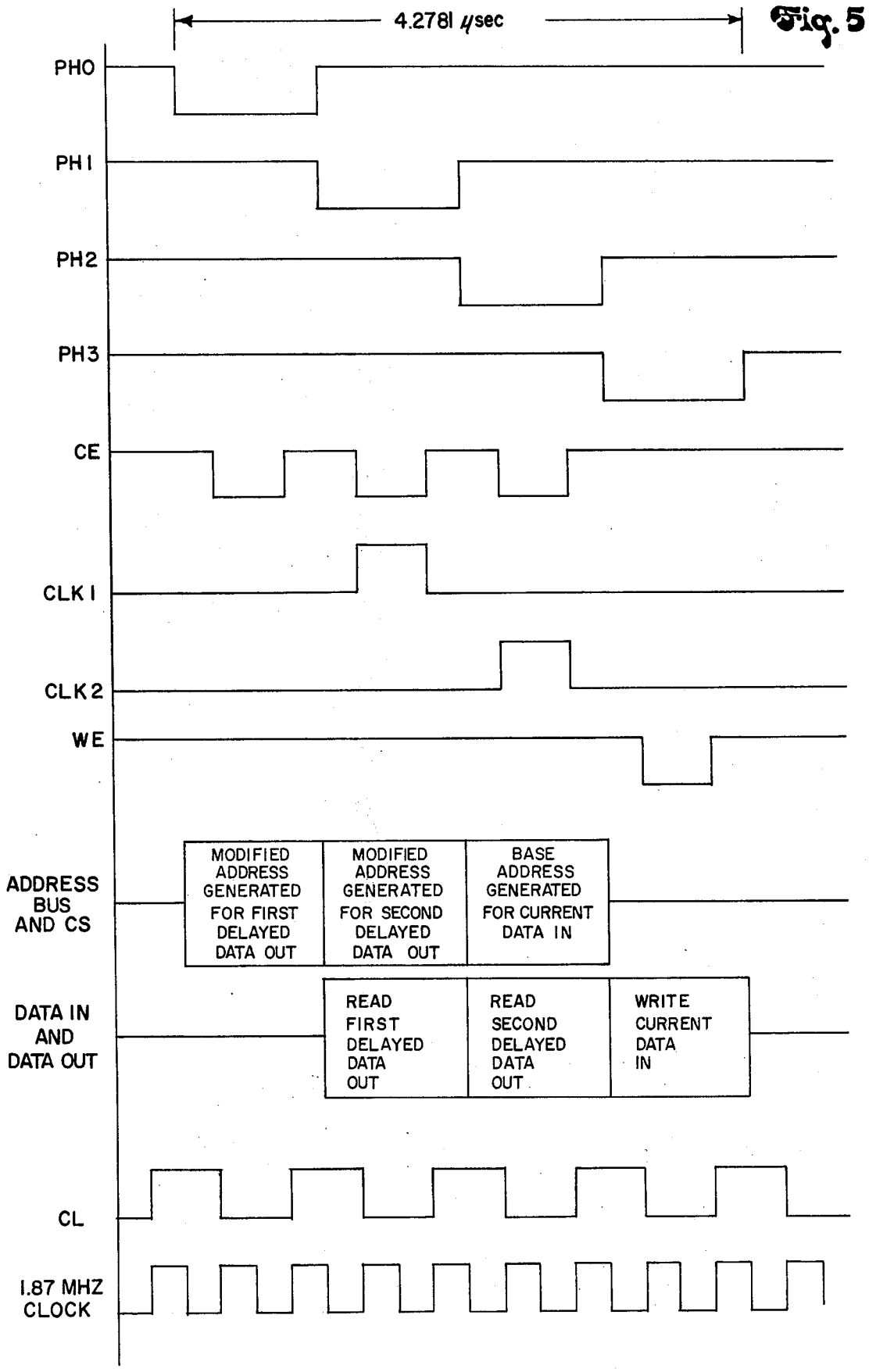
FIG. 5 is a timing diagram which illustrates the events which occur in the ambience processor of FIG. 1.

Referring particularly to FIGS. 3 and 5, the control signals for the ambience processor are generated by the flip-flop 98 and the decoder circuit 93. The $\overline{Q}$ output terminal on the flip-flop 98 connects to a CL control line 110 which not only increments the sixteen-bit binary counter 94 through its terminal 97, but also is used to derive the other control signals employed by the system. The four output terminals on the decoder circuit 93 connect to four control lines PH0, PH1, PH2 and PH3. Control line PH0 connects through an inverter gate 111 to the selector switch 24, control line PH1 connects through an inverter gate 112 to the selector switch 24 and the control line PH2 connects directly to the selector switch 24. The CL control line 110 and control line PH1 also connect to a NOR gate 113 which drives the CLK1 control line 16 and the CL control line 110 and PH2 control line connect to a NOR gate 114 which drives a CLK2 control line 115. The write enable (WE) control line 92 is driven by an OR gate 116 which connects to the CL control line 110 and the PH3 control line, and the chip enable (CE) control line 91 is driven by a circuit which connects to the CL control line 110 and the PH3 control line. The chip enable control line 91 is driven low by an inverter gate 117 and it is driven high by an inverter gate 118 which drives an NPN transistor 119. A chip enable control signal suitable for application to the MOS dynamic RAMs is thus provided.

Referring particularly to FIGS. 3 and 5, a basic sample period of 4.2781 microseconds is established by the control signals and this sample period is divided into four phases by the control lines PH0–PH3. The memory 18 is successively addressed during phases PH0–PH2 and delayed data is read from the memory 18 during phases PH1 and PH2 and current data is written into the memory 18 during phases PH3. The CL control line 110 increments the sixteen-bit binary counter 94 to generate the successive phases, and on every fourth clock pulse, the base address applied to the delay memory 18 is changed to start a new 4.2781 microsecond sample period. Over a "scan" period of 70.1 milliseconds all 16,383 memory locations in the delay memory 18 are sequentially addressed and written into, and the sixteen-bit binary counter 94 is then automatically reset and the scan is repeated.

During each 4.2781 microsecond sample period the memory address circuitry 19 generates a base address and two modified addresses. The modified addresses are generated during phases PH0 and PH1 during which memory read operations are initiated. The base address is generated during phase PH2 during which the memory write operation is initiated. As indicated in FIG. 5, data is actually read from the memory 18 during phases PH1 and PH2 and current data is written into the memory 18 during phase PH3.

The modifications to the base address during each sample period is performed by the four-bit binary adder circuit 100 and the magnitudes of the modifications are determined by the setting of the selector switch 24. Referring particularly to FIG. 3, during phase PH0 the four poles of the selector switch 24 apply a four-bit binary code to the A inputs 101 on the four-bit binary adder 100 which is added to the base address being generated during that sample period. On the other hand, during the PH1 phase of the same sample a different four-bit binary number is generated by the selector switch 24 and added to the base address. During the PH2 phase the base address is generated and the position of the selector switch 24 has no effect. Data is read from the delay memory 18 when the two modified addresses are generated by the memory address circuit 19 and current data is written into the memory 18 when the base address is generated. Data which was previously stored in the delay memory 18 is thus read out when each of the modified addresses are generated, and because the modified addresses are different, the first data out and second data out are delayed different predetermined amounts.

The amount of the delay is determined by the setting of the selector switch 24. Table A lists the four-bit binary numbers generated by the selector switch 24 for each of its settings and the consequent time delays. The data read from the memory 18 during the PH1 phase is delayed for a longer time interval than the data read from the memory during the PH2 phase. As will be described in more detail hereinafter, the first delayed data is applied to the left channel digital-to-analog converter circuit 23 in synchronizm with CLK1 and the data read from the memory 18 during the PH2 phase is applied to the right channel digital-to-analog converter circuit 22 in synchronizm with CLK2. In the preferred embodiment described herein, therefore, the left channel data is delayed longer than the right channel data and a ratio of approximately 1.0:0.6 has been found to provide a pleasing ambience effect.

Figure 4:
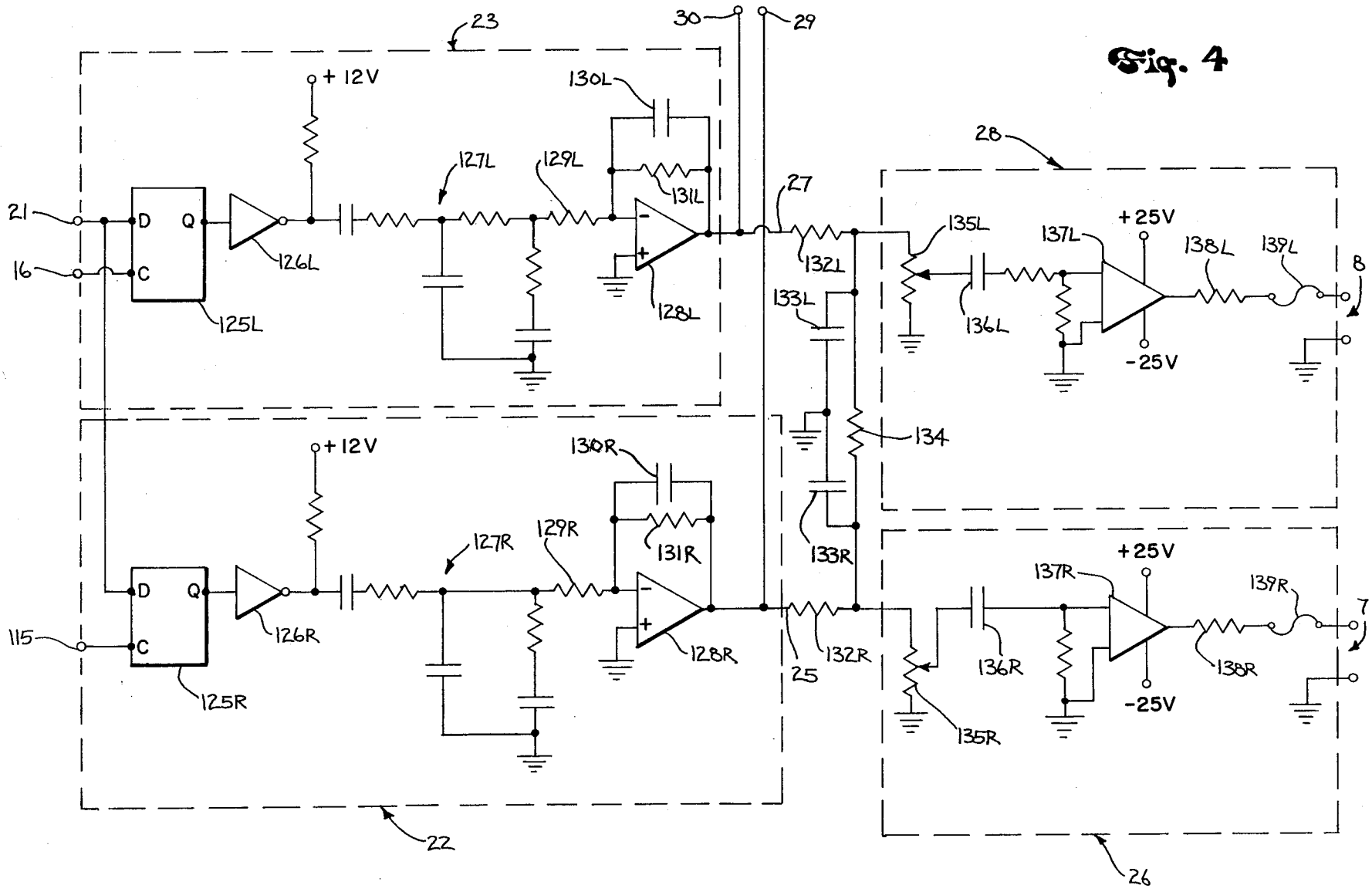
FIG. 4 is an electrical schematic diagram of digital-to-analong converter circuits and output circuits which form part of the ambience processor of FIG. 1.

Referring particularly to FIGS. 1 and 4, two delayed digital data signals are read from the delay memory 18 and applied to the respective digital-to-analog converter circuits 23 and 22. The sequence of digital data applied to the digital-to-analog converter 23 represents an analog signal which is delayed a first predetermined amount, and the sequence of digital data applied to the digital-to-analog converter circuit 22 represents an analog signal which has been delayed a second predetermined amount. The digital-to-analog converter circuits 22 and 23 are identical to one another as are the output circuits 26 and 28. In the following description, therefore, the left channel circuitry will be described in detail and the reference numbers employed to identify the components therein will include the suffixe "L." The corresponding identical elements in the right channel circuitry are identified on the drawings with the identical reference number followed by the suffixe "R."

The data ouput line 21 from the delay memory 18 is connected to the D input terminal on a D-type flip-flop 125. The CLK1 control line is connected to the clock input on the flip-flop 125 L and the CLK2 control line 115 is connected to the clock input on the flip-flop 125 R. The resulting signal at the Q output of the flip-flop 125 is converted to a clean, large-swing signal by an inverter gate 126 and it is then filtered by a network 127 before being applied to an integrator circuit. The filter network 127 reduces noise introduced during the delta modulation process.

The integrator circuit includes an operational amplifier 128 which has its noninverting input connected to signal ground and its inverting input connected to receive the delayed digital data through a resistor 129. A feedback capacitor 130 connects to its output terminal and the values of the resistor 129 and capacitor 130 are selected to duplicate the action of the integrator circuit used in the analog-to-digital converter circuit 12. A feedback resistor 131 is also provided to provide d.c. stability. A low pass filter comprised of resistor 132 and capacitor 133 is connected to the output of the operational amplifier 128 to further filter out any noise introduced into the delayed analog audio signal.

The delayed analog audio signals generated by the operational amplifiers 128 L and 128 R are applied directly to the reverberation circuit 13 through the lines 30 and 29. As described above, these separate analog audio signals are summed by the reverberation circuit 13 and a portion of the combined audio signal is fed back to the analog-to-digital converter circuit 12 for reprocessing. In addition, some intermixing of the two delayed audio signals is provided at the outputs of the digital-to-analog converter circuits 22 and 23 by a resistor 134. This mixing of the delayed audio signals has been found to enhance the subjective character of the separate ambience signals applied to the left channel output circuit 128 and the right channel output circuit 126.

The ambience signals applied to the inputs of the output circuits 26 and 28 are complex, multiply recycled, time-delayed mixtures of the left and right channel audio signals applied to the input of the ambience processor. The output circuits 26 and 28 amplify these ambience signals to a level suitable for driving the ambience loudspeakers 9 and 10. More specifically, the ambience signal is applied to a potentiometer 135 and a portion of the signal is coupled through a capacitor 136 to the input of a power amplifier 137. The output of the power amplifier is coupled through a resistor and a fuse 139 to the output lines which connect with the ambience loudspeakers. The power amplifier 137 is a commercially available amplifier manufactured by Sanyo Semiconductor and sold as the Model STK-459. It provides approximately fifteen watts of power to the ambience loudspeaker 9 or 10 which it drives.

COMPONENT APPENDIX

| Component | Description |
|---|---|
| Operational Amplifiers 30, 31, 32, 56, 73 and 128 | RC 4136 operational amplifiers manufactured by Raytheon |
| Comparator 54 | LM 311 voltage comparator manufactured by National Semiconductor, Inc. |
| Flip-flops 55, 98, 125 | SN74LS74 D-Type edge triggered flip-flop manufactured by Texas Instruments, Inc. |
| Random Access Memory Circuits 82–85 | MM5280 4096-bit dynamic random access memory manufactured by National Semiconductor, Inc. |
| Counter 94 | Four SN74LS163 synchronous 4-bit counters manufactured by Texas Instruments, Inc. |
| Decoders 93 & 106 | SN74LS139 decoder/multiplexer manufactured by Texas Instruments, Inc. |
| Binary Adder 100 | SN74LS83 4-bit binary full adder manufactured by Texas Instruments, Inc. |
| Power Amplifiers 137 | Model STK 459 manufactured by Sanyo Semiconductor. |

We claim:

1. An ambience processor which comprises:

an input circuit for receiving and combining the audio signals of a multi-channel audio system to form a composite audio signal;

an analog-to-digital converter circuit connected to receive the composite audio signal from said input circuit and operable to generate a first sequence of digital signals which is a digital representation of the composite audio signal;

a random access memory coupled to said analog-to-digital converter circuit for storing at successive base memory locations said first sequence of digital signals;

memory address circuit means coupled to the random access memory for reading from successive first modified addresses a second sequence of digital signals which represents the composite audio signal delayed a first predetermined amount, and for reading from successive second modified addresses a third sequence of digital signals which represents the composite audio signal delayed a second predetermined amount;

a first digital-to-analog converter circuit for receiving and converting said second sequence of digital signals into a first delayed audio signal;

a second digital-to-analog converter circuit for receiving and converting said third sequence of digital signals into a second delayed audio signal; and means for coupling said first and second delayed audio signals to respective first and second audio reproducers.

2. The ambience processor as recited in claim 1 in which said analog-to-digital converter circuit is a delta modulator circuit, a diode bridge circuit is connected thereto to detect an overload condition, and an illuminating device is connected to the diode bridge circuit to provide a visual indication of an overload condition.

3. The ambience processor as recited in claim 1 in which said multi-channel audio system is a stereophonic power amplifier and a pair of isolation transformers couple the respective left channel and right channel audio signals generated by said stereophonic power amplifier to respective first and second input terminals on said input circuit.

4. The ambience processor as recited in claim 3 in which said input circuit includes a first operational amplifier coupled to said first input terminal, a second operational amplifier coupled to said second input terminal, and a third operational amplifier which couples to said first and second operational amplifiers and which operates to sum the left channel and right channel audio signals to form said composite audio signal.

5. The ambience processor as recited in claim 1 which includes a reverberation circuit that connects to receive a portion of said first and second delayed audio signals and is operable to sum them to form a feedback signal which is coupled to said analog-to-digital converter circuit.

6. The ambience processor as recited in claim 5 in which said reverberation circuit includes an operational amplifier and means for manually adjusting the magnitude of said feedback signal.

7. The ambience processor as recited in claim 1 in which said memory address circuit means includes a counter which generates a multi-bit base address on an address bus to said random access memory for selecting a memory location therein, clock means for periodically incrementing said counter, and adder means coupled to said address bus and operable in synchronism with said clock means to modify each generated base address by a first preselected amount to generate a first modified address and to modify each generated base address by a second preselected amount to generate a second modified address.

8. The ambience processor as recited in claim 7 in which a manually operable switch is coupled to said adder means for selecting the amount of address modification.

9. A signal processor which comprises:

(a) means for combining the signals of a multi-channel audio system whereby a monaural signal is formed;

(b) signal delay means providing signals delayed by first and second predetermined amounts;

(c) means for coupling said monaural signal to the input of said delay means;

(d) means for coupling a portion of the signal delayed by said first predetermined amount to the input of said delay means;

(e) means for coupling a portion of the signal delayed by said second predetermined amount to the input of said delay means; and (f) means for coupling each of said signals delayed by said first and second predetermined amounts to audio reproducers.

10. A signal processor as recited in claim 9 and further including a plurality of isolation transformers for coupling said signals of said multi-channel audio system to said combining means.

11. A signal processor which comprises:

(a) means for combining the signals of a multi-channel audio system whereby a monaural signal is formed;

(b) signal delay means providing signals delayed by first and second predetermined amounts;

(c) means for coupling said monaural signal to the input of said delay means;

(d) means for coupling a portion of the signal delayed by said first predetermined amount to the input of said delay means;

(e) means for coupling a portion of the signal delayed by said second predetermined amount to the input of said delay means; and (f) first and second amplifying means for amplifying said signals delayed by said first and second predetermined amounts.

* * * * *